US006364719B1

(12) United States Patent
Chopra

(10) Patent No.: US 6,364,719 B1
(45) Date of Patent: Apr. 2, 2002

(54) BATTERY TERMINAL CONNECTOR

(75) Inventor: Kewal K. Chopra, Macomb County, MI (US)

(73) Assignee: The United States of America as represented by the Secretary of the Army, Washingon, DC (US)

( * ) Notice: Subject to any disclaimer, the term of this patent is extended or adjusted under 35 U.S.C. 154(b) by 0 days.

(21) Appl. No.: 09/820,840

(22) Filed: Mar. 30, 2001

(51) Int. Cl.[7] ..... H01K 4/48
(52) U.S. Cl. ..... 439/759; 439/835
(58) Field of Search ..... 439/759, 755, 439/504, 506, 772, 726, 729, 835; 324/555, 556; 219/143

(56) References Cited

U.S. PATENT DOCUMENTS 3,764,961 A * 10/1973 Poitras ..... 439/759
4,470,654 A * 9/1984 Friedman ..... 439/759
5,720,633 A * 2/1998 Krivec ..... 439/759

* cited by examiner

*Primary Examiner*—Hien Vu
(74) *Attorney, Agent, or Firm*—David L. Kuhn; Gail S. Soderling; Clifford Clay Carter

(57) ABSTRACT

The present invention is an improved linear action battery clamp usefull for attaching a battery cable to a vehicle's battery terminal. The clamp has a frame member with a fixed jaw and a fixed handle. An actuator rod is mounted in the frame the rod being mounted within first and second bores. The rod has a second jaw mounted on one end moveable towards the fixed jaw of the frame to clamp a battery terminal.

A sliding actuator is mounted on the rod being adapted to move the rod linearly the actuator being juxtaposed an actuating arm attached to the frame, the arm having a pair of cam surfaces on one end juxtaposed the actuator for moving the actuator.

A brake member acts on the rod the brake normally restricting the rods' linear motion serving to hold the rod in a fixed position. The brake has a release position that allows the rod to be moved in the opposite direction by hand so as to open or disengage the jaw.

1 Claim, 1 Drawing Sheet

BATTERY TERMINAL CONNECTOR

GOVERNMENT INTEREST

The invention described herein may be made, used and licensed by The United States Government for all governmental purposes without paying me any royalty.

BACKGROUND OF THE INVENTION

1. Field of the Invention

In one aspect this invention relates to battery clamps. In yet a further aspect this invention relates to clamps that are easily attached and removed from vehicle battery terminals.

2. Prior Art

In general, conventional battery booster cables have a clamp made with two levers joined by a rivet with a helical spring disposed about the rivet, the spring biasing the levers to maintain the jaw portion of the levers together in a closed position. Squeezing the levers and placing the jaws around a battery terminal can open the clamp. This type of clamp is widely used because it is cheap and easy to use. However many of the modern vehicles have the battery terminals on the side of the battery and such clamps are difficult to attach. Also occasionally they jump off the battery terminal if they are not properly attached. In addition to placement of the terminal, battery terminals are subject to harsh corrosive forces that coat and degrade the surface of the terminals making electrical connections difficult. The ability to increase the force on the terminal clamps, even slightly, would increase the ability of the clamp to break through corrosion and debris on the terminal and effect electrical connection.

A different form of battery clamp is shown in U.S. Pat. No. 5,720,633. This patent shows a linear movement clamp with one fixed jaw and one moveable jaw normally biased to a clamping position but with a lever that can be activated to separate the jaws for placement on the battery terminal. This type of clamp does allow the jaws to be configured to allow placement on side mounted terminal as well as top mounted terminal. However, like other prior art structures it is normally biased into the closed position. Thus, maximum clamping force is determined by the biasing means. Too great a bias will make the clamp hard to open limiting its usefulness. Too little clamping force will result in inadequate clamping force and inadequate electrical connections of the clamps. Because of its long handle and very small jaws, it has a tendency to slip or jump out of the battery terminal.

It is a general object of the present invention to provide a linear clamping device that can be easily attached to vehicle battery terminals whether located on the side or top of the battery. It is also an object to provide a clamp that can be activated to provide additional clamping force, for firm and positive quick attachment when needed to effect good electrical conductivity.

SUMMARY OF THE INVENTION

Briefly, the present invention is an improved linear action battery clamp useful for attaching a battery cable to a vehicle's battery terminal. The clamp has a frame member with a fixed jaw positioned on one end of the frame and a fixed handle located on the end of the frame opposite the fixed jaw. The frame has first and second coaxially aligned bores formed in the frame and a chamber or opening located between the first and second bores.

A reciprocating actuator rod is mounted in the frame with a portion of the rod being mounted within and passing through the first and second bores. The rod has a second jaw mounted on one end so that the second jaw is moveable towards the fixed jaw of the frame to clamp a battery terminal when clamp is activated.

A sliding actuator is mounted on the rod within the chamber. The actuator is biased to a first ready position, where the actuator grips the rod and moves the rod linearly when the actuator is moved toward its second position by an actuating force. The biasing means associated with the actuator returns the actuator to its first position when the actuating force is removed.

A lever or actuating arm is pivotally attached to the frame near the fixed handle to form an actuation grip the pivoting arm having paired cam surfaces on one end juxtaposed the actuator. When the actuating arm is pivoted by moving the arm towards the fixed handle, a cam surface on the end of the arm near the chamber the cam surface contacts the actuator and moves the actuator to the second position. When the force on the actuating arm is released, the biasing means will return the actuating arm to its normal position. The actuator arm can then be activated again to provide further tightening action if necessary.

A brake member connected to the frame near the fixed handle acts on the rod. The brake is normally biased to a braking position that restricts the rods linear motion allowing the rod to move so the moveable jaw engages the fixed jaw, and serving to hold the rod in a fixed position. The brake has a release position that allows the rod to be moved in the opposite direction by hand so as to open or disengage the jaw.

DETAILED DESCRIPTION

Figure 1:
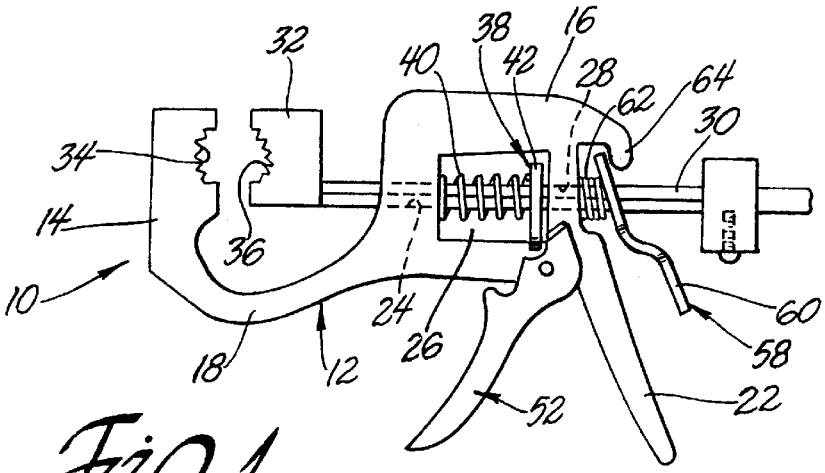
FIG. 1 is a side view of one embodiment of his invention.
Figure 2:
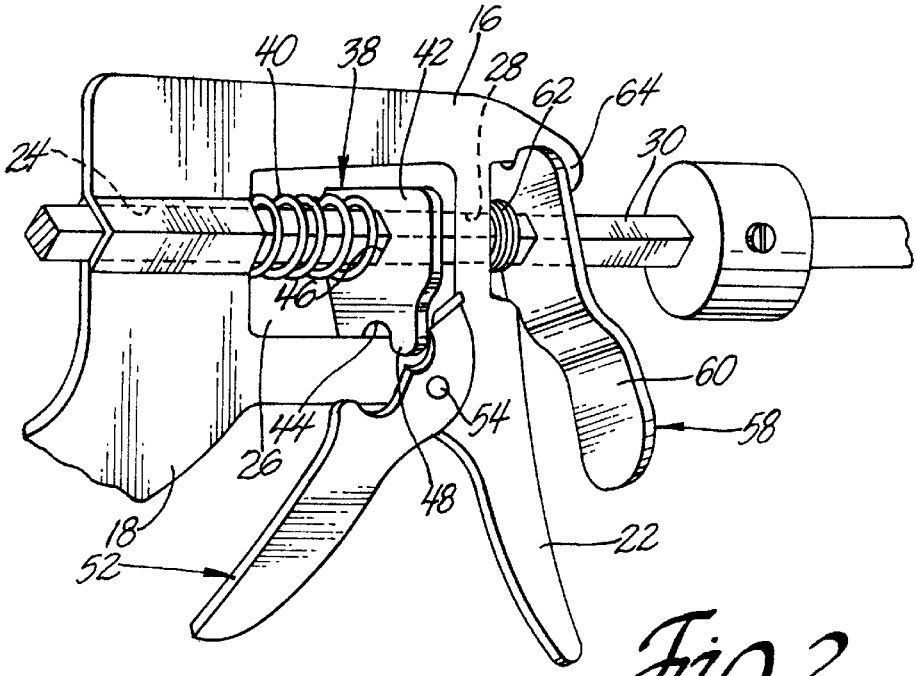
FIG. 2 is a partial side view showing the jaws of FIG. 1.

Referring to the accompanying drawing in which like numerals refer to like parts and initially to FIG. 1, an improved linear action battery clamp according to this invention is designated generally 10. The clamp 10 has a frame member 12 with a fixed jaw 14 attached to a frame body 16 through an arm 18. The arm 18 holds the fixed jaw 14 in position with respect to the remainder of the frame 12 so the arcuate toothed inner surface 34 of the fixed jaw retains the desired alignment with respect to the frame. The frame body 16 also has a fixed handle 22 located on the end of the frame 12 opposite arm 18 and fixed jaw 14.

The frame body 16 has a first bore 24 located on one side of a chamber 26 and a second coaxially aligned bore 28 located on the other side of the chamber. When taken together the bores 24, 28 form a channel that serves to define a linear path for activating the clamp as will be apparent from the discussion hereinafter.

An actuator rod 30 is mounted in the frame 16 and as shown, has a square cross section complimentary to the cross section of bores 26, 28. This configuration will keep the rod 30 from twisting thus keeping the teeth aligned as pressure is applied to the rod during clamp activation. The rod 30 is constructed with a moveable jaw 32 located within the open area between the frame body 16 and the first jaw 14. The second jaw 32 can move linearly towards or away from the fixed jaw 14 to clamp and release. The jaws 14, 32 have arcuate, complimentary toothed inner surfaces 34, 36 that cooperate to form a nominally circular cavity when closed. The cavity defined will be sized so the minimum diameter defined by the points of the teeth will firmly engage the smallest standard vehicle battery terminal as the jaws are closed. The teeth provide a means to penetrate the corrosion to ensure there is solid electrical contract between the clamp and the battery terminal. The rod 30 being mounted within two separated bores which are axially aligned and the square shape of the rod combine to produce a system that has a high degree of linearity when the rod is moved. The free end of rod 30 will have an electrical connection to a cable. Such a connection can be of various standard connectors. Such connectors are well known and are not part of this invention. Further discussion is omitted in the interest of brevity.

Figure 3:
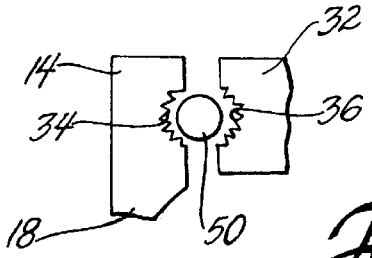
FIG. 3 is a detailed perspective view of the actuating braking means of FIG. 1.

A biased sliding actuator 38 is mounted on the rod 30 within the chamber 26. The actuator 38 shown includes two separate pieces, a spring biasing means 40 and a plate 42. The plate 42 is formed with a square aperture 46 slightly larger than the rod 16 cross section so the plate can move along the rod freely when it is orthogonal to the rod. The plate 42 has two ears 48 depending from one edge of the plate the ears forming a recess between the ears into which a portion of the frame 16 extends keeping the plate axially aligned with the frame when the plate is moved within the chamber 26 during actuation. The actuator plate 42 is normally biased to a first ready position that is shown in FIG. 3. When an actuating force is applied to the actuator plate 42 on ears 48, the actuator plate will be canted with respect to the actuator rod 30 which in turn causes the aperture in plate 42 to engage the rod 16 and move the rod in the same direction as the actuator plate. When the force on the plate 42 is released, a biasing means, spring 40, will return the actuator plate 42 to an orthogonal orientation where its aperture does not engage the rod 16 and the spring can return the actuator plate to its first position to allow further actuation if needed to close the jaws 14, 32 to a clamping position where they contact a battery terminal 50.

A lever or actuating arm 52 is attached to the frame 12 near the fixed handle 22 by means of a pivot point 54, such as an axle, passing through the lever arm and frame forming a bearing for the lever arm. Actuating arm 52 and fixed grip 22 cooperate to form an actuation grip for the present invention. The actuating arm 52 has two flanges 56 that function as a cam surface located on the end of the actuation arm juxtaposed the actuator plate 42. When the actuating arm 52 is moved by squeezing the actuating arm 52 to a position nearer the fixed handle 22, the two flanges 56 contact the actuator plate 42 and push the actuator plate in the direction of the fixed jaw 14. When the force on the actuating arm 52 is released, the biasing spring 40 will return the actuating arm to its normal position shown in FIG. 1. The actuating arm 52 can be activated again to provide further motion for closing and tightening the jaws 14,32.

A brake member 58 is located near and connected to the frame 16. As shown, the brake member 58 is located near the fixed handle 22 and includes a lever arm 60 that has an aperture through which the rod 30 passes. The lever arm 60 has a biasing means, spring 62, which acts on the lever arm 60 biasing the lever arm to a canted position shown in FIG. 3 where the rod 30 is engaged by the aperture in the lever arm. One end of the lever arm 60 is in contact with a detent 64 that prevents the rod from being drawn out of the frame 16 when the lever is biased to its normal position. When the end of the lever 60 opposite that of the end engaging the detent 64 is moved the aperture in lever arm 60 will disengage the rod 30 and allow the rod to be moved manually in either direction by grasping and pushing the rod. The brake 58 is normally biased to a braking position which restricts linear motion of the rod allowing the rod 30 to move so the moveable jaw 32 engages the fixed jaw 14 and serves to hold the rod in a fixed position until the brake is released. The brake's released position allows the rod 30 to be moved by hand so as to open or disengage the jaw.

Various alterations and modifications will become apparent to those skilled in the art without departing from the scope and spirit of this invention and it is understood this invention is limited only by the following claims.

What is claimed is:

1. An improved linear action battery clamp for attaching a battery cable to a battery terminal including:

a frame member, having a fixed jaw positioned on one end and a fixed handle located on the end of the frame opposite the fixed jaw, the frame member having first and second coaxially aligned bores formed in the frame member, and a chamber formed in the frame member between the first and second bores;

a biased, reciprocating actuator rod mounted in the frame member, at least a portion of the rod being mounted within and passing through the first and second bores, the rod having a second jaw mounted on one end so that the second jaw is juxtaposed the fixed jaw of the frame member;

a reciprocating, biased sliding actuator including biasing sprig means mounted on the rod with the chamber in said frame member, the actuator being normally biased into a first ready position by said biasing spring means, the actuator gripping the rod and moving it linearly when the actuator is moved toward its second position by a motive force and returning to the first position when actuating forces are removed;

a lever arm pivotally attached to the fixed handle to form an action grip, the pivoting lever arm having a cam surface on an end of the lever arm near the chamber formed in the frame member, the cam being in contact with the actuator when the actuator is in the first position and serving to move the actuator to the second position when the lever arm is rotated by moving the lever am to a position juxtaposed the fixed handle, and returning to a normal position when activation pressure is released by action of the biasing spring means of said actuator, a brake member connected to the rod, the brake member normally being biased to a braking position to hold the rod fixed in position and having a release position which allows manual movement of the rod to a desired position.

* * * * *